US006211755B1

(12) United States Patent
Kubota et al.

(10) Patent No.: US 6,211,755 B1
(45) Date of Patent: Apr. 3, 2001

(54) DIELECTRIC RESONATOR, DIELECTRIC FILTER, DIELECTRIC DUPLEXER, COMMUNICATION DEVICE, AND METHOD OF PRODUCING DIELECTRIC RESONATOR

(75) Inventors: Kazuhiko Kubota, Mukou; Tomoyuki Ise, Nagaokakyo, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/301,250

(22) Filed: Apr. 28, 1999

(30) Foreign Application Priority Data

Apr. 28, 1998 (JP) ..... 10-118933

(51) Int. Cl.[7] ..... H01P 7/10; H01P 1/20; H01P 5/12

(52) U.S. Cl. ..... 333/219.1; 333/202; 333/134

(58) Field of Search ..... 333/202, 219.1, 333/134, 219

(56) References Cited

U.S. PATENT DOCUMENTS 4,706,052 * 11/1987 Hattori et al. ..... 333/219
5,004,992 * 4/1991 Grieco et al. ..... 333/202
5,097,238 * 3/1992 Sato et al. ..... 333/219.1
5,136,270 * 8/1992 Hatanaka et al. ..... 333/219.1
5,714,919 * 2/1998 Satoh et al. ..... 333/202
5,920,243 * 7/1999 Ishikawa et al. ..... 333/204

FOREIGN PATENT DOCUMENTS 07 16 46 8 A1 6/1996 (EP) .
61-136302 6/1986 (JP) .
5-327324 12/1993 (JP) .
8-242109 9/1996 (JP) .

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric resonator including a substantially columnar dielectric, thin film multi-layer electrodes each formed around two faces opposite to each other of the dielectric, and a concave portion formed substantially evenly on the peripheral side-face of the dielectric.

19 Claims, 11 Drawing Sheets

DIELECTRIC RESONATOR, DIELECTRIC FILTER, DIELECTRIC DUPLEXER, COMMUNICATION DEVICE, AND METHOD OF PRODUCING DIELECTRIC RESONATOR

BACKGROUND OF THE INVENTION

1. Field of the Invention

The present invention relates to a dielectric resonator, a dielectric filter, a dielectric duplexer, and a communication device each for use in a communication base station, and a method of producing a dielectric resonator.

2. Description of the Related Art

Such dielectric resonator and dielectric filter will be described with reference to FIGS. 12 through 14. FIG. 12 is a perspective view of the dielectric resonator. FIG. 13 is a partly cross sectional view of one end of the dielectric resonator. FIG. 14 is an exploded perspective view of the dielectric filter. In this case, the filter will be described by use of a two stage band-elimination dielectric filter in which two dielectrics are connected with a quarter-wave line. This filter was not a publicly known conventional technique when Japanese Patent Application No. 10-118933, which is a basis of claim of priority for the application of the present invention, was filed.

As shown in FIGS. 12 and 13, a dielectric resonator 110 is composed of a columnar dielectric 111, and thin film multi-layers 112 formed on the opposite sides of the dielectric 111. In the case that the thin film multi-layer electrodes 112 are employed as the electrodes of the dielectric resonator 110, the nonloaded Q of the dielectric resonator 110 is enhanced. As compared with monolayer silver electrodes used as the electrodes, the dielectric resonator with high characteristics can be provided.

In addition, as shown in FIG. 14, a dielectric filter 120 is made up of a shield cavity 121 made of iron or the like, two dielectric resonators 110 arranged in the shield cavity 121, and a ground plate 122, electrical probes 123 as external coupling means, and external connectors 124 attached to the shield cavity 121.

As described above, each dielectric resonator 110 is formed of the columnar dielectric 111 having the thin film multi-layer electrodes 112 formed on the opposite sides thereof. One electrode surface of the dielectric resonator 110 is soldered to the ground plate 122 having a step 122*a* and a hole 122*b* for soldering. The ground plate 122 is sandwiched between the body 121*a* of the shield cavity 121 and a lid 121*b*. Thus, the dielectric resonator 110 is arranged in the shield cavity 121. In addition, the electrical probes 123 are connected at one end to the center conductors of the external connectors 124, respectively, and are elongated in the spaces between the dielectric resonators 110 and the shield cavity 121. Moreover, the center conductors of the two external connectors 124 are connected through a quarter-wave line 125.

In the dielectric filter 120 having the above-described configuration, an input signal, when it is input through the external connectors 124, is transmitted to the electrical probes 123, so that the electrical probes 123 and the dielectric resonators 110 are capacitively coupled. Then, the dielectric resonators 110 resonate at a resonant frequency determined by the shapes and sizes of the dielectric resonators 110. Thus, the dielectric filter 120 in which the dielectric resonators are connected through the quarter-wave line 125 for connection is provided functions as a band-elimination dielectric filter for eliminating the desired frequency.

In general, a great number of dielectric resonators having a predetermined diameter and thickness are produced at one time. Accordingly, in order to allow the dielectric resonators to be used in dielectric filters of which the frequency characteristics are different, it is necessary to adjust the resonant frequencies of the dielectric resonators in correspondence to the frequencies. To make this adjustment, in the above-described dielectric resonator, it is possible to cut either the peripheral side-face of the dielectric resonator having thin film multi-layer electrodes formed on the opposite sides thereof, including the thin film multi-layer electrodes, to partially cut or the thin film multi-layer electrodes.

However, as shown in FIG. 15, if the adjustment of the resonant frequency is carried out by the above-described method, for example by cutting, the peripheral side-face of the dielectric 111, in the thin film multi-layer electrode 112 comprising metallic layers 112*a* made of copper or the like and dielectric layers 112*b*, due to the rolling properties of the metallic layers 112*a*, a part of the metallic layers 112*a* of the thin film multi-layer electrode 112 will be short circuited, so that the nonloaded Q of the dielectric resonator 110 will be reduced. Therefore, after the peripheral side-face is cut to adjust the resonant frequency of the dielectric resonator, etching or the like is required to remove the short circuiting portion of the thin film multi-layer electrode. Thus, the number of production processes is increased.

Further, to adjust the resonant frequency of the dielectric resonator, a method of cutting the dielectric portion of the dielectric resonator excluding the thin film multi-layer electrode may be proposed. However, to adjust roughly the resonant frequency, it is required to cut an amount of the dielectric. When the dielectric of the dielectric resonator is partially removed, the symmetric structure of the dielectric resonator is unbalanced, so that the current distribution becomes uneven, and the nonloaded Q of the dielectric resonator is reduced.

SUMMARY OF THE INVENTION

In view of the foregoing, a dielectric resonator, a dielectric filter, a dielectric duplexer, a communication device, and a method of producing the dielectric resonator of the present invention have been devised. Accordingly, it is an object of the present invention to solve the above-described problems and to provide a dielectric resonator, a dielectric filter, a dielectric duplexer, and a communication device each having a high nonloaded Q. and a method of producing the dielectric resonator.

According to the present invention, there is provided a dielectric resonator which comprises a substantially columnar dielectric, a thin film multi-layer electrode formed on at least one of two faces opposite to each other of the dielectric, and a concave portion formed substantially evenly on the peripheral side-face of the dielectric.

A dielectric filter of the present invention comprises a shield cavity with conductive properties, a dielectric resonator, and an external coupling means to be coupled to the dielectric resonator, the dielectric resonator including a substantially columnar dielectric arranged in the shield cavity, a thin film multi-layer electrode formed on at least one of two faces opposite to each other of the dielectric, and a concave portion formed substantially evenly on the peripheral side face of the dielectric.

A dielectric duplexer of the present invention comprises a shield cavity with electroconductive properties, a dielectric resonator, an external coupling means to be coupled to the dielectric resonator, and an input-output connection means connected to the external coupling means and an antenna connection means, the dielectric resonator including a substantially columnar dielectric arranged in the shield cavity, a thin film multi-layer electrode formed on at least one of two faces opposite to each other of the dielectric, and a concave portion formed substantially evenly on the peripheral side face of the dielectric.

A communication device of the present invention comprises a dielectric duplexer, one of a transmission circuit and a receiving circuit connected to the dielectric duplexer, and an antenna connected to said dielectric duplexer, the dielectric duplexer including a shield cavity with conductive properties, a dielectric resonator, an external coupling means to be coupled to the dielectric resonator, an input-output connection means connected to the external coupling means and an antenna connection means, the dielectric resonator including a substantially columnar dielectric arranged in the shield cavity, a thin film multi-layer electrode formed on at least one of two faces opposite to each other of the dielectric, and a concave portion formed substantially evenly on the peripheral side-face of the resonator.

Accordingly, since the symmetrical structure of the dielectric resonator is kept, the current distribution is not disturbed. Further, the thin film multi-layer electrode formed in the dielectric resonator is prevented from being short-circuited.

Furthermore, a method of producing a dielectric resonator comprises the steps of: forming a thin film multi-layer electrode on at least one of two faces opposite to each other of a substantially columnar dielectric and an electrode on the other face, and fixing the dielectric to a rotation apparatus, and rotating the dielectric to cut substantially evenly the peripheral side-face of the dielectric by use of a cutting means.

Thus, the dielectric resonator of which the symmetrical structure can be easily kept can be produced without the thin film multi-layer electrode short-circuited.

PREFERRED EMBODIMENT OF THE INVENTION

Figure 1:
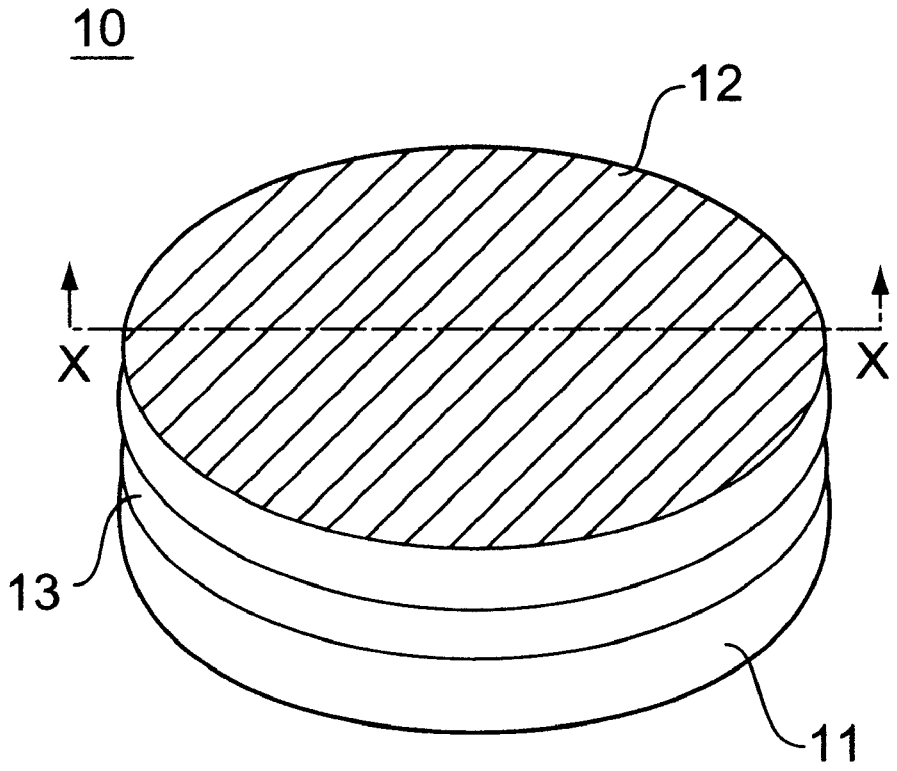
FIG. 1 is-a perspective view of a dielectric resonator according to the present invention.

A dielectric resonator according to an embodiment of the present invention will be now described with reference to FIGS. 1 and 2. FIG. 1 is a perspective view of the dielectric resonator, and FIG. 2 is a cross sectional view taken on line X—X of FIG. 1.

Figure 2:
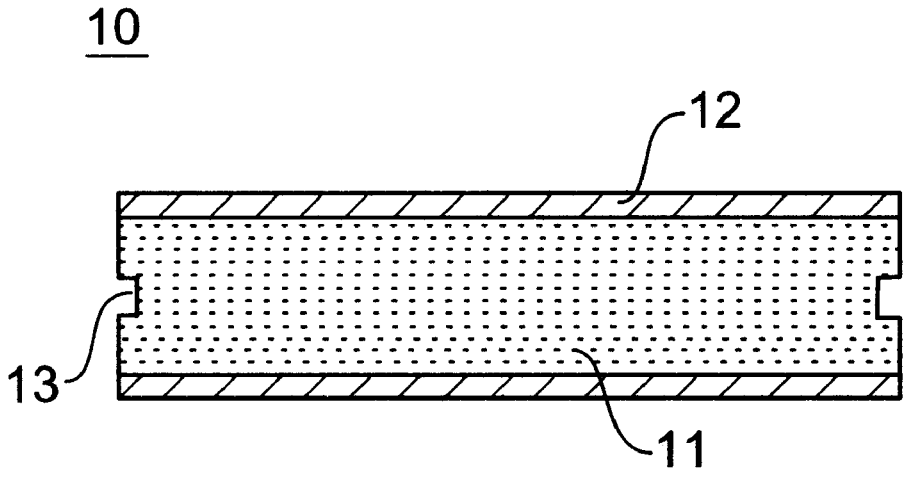
FIG. 2 is a cross sectional view taken on line X—X of FIG. 1.

As shown in FIGS. 1 and 2, dielectric resonators 10 of the instant embodiment each is made up of a columnar dielectric 11, thin film multi-layer electrodes 12 formed on two faces opposite to each other of the dielectric 11, and a concave portion 13 substantially evenly formed on the peripheral side-face of the dielectric 11. With the depth and width of the concave portion 13, the resonant frequency of the dielectric resonator 10 is adjusted.

Figure 3:
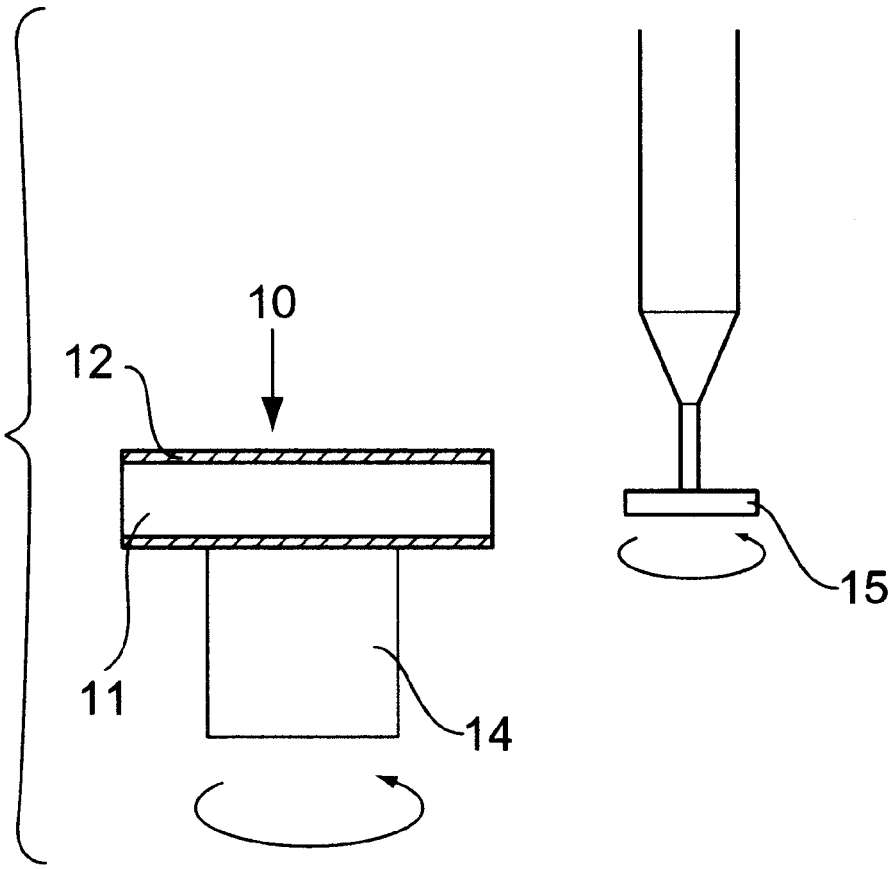
FIG. 3 is an illustration of a part of production process for the dielectric resonator according to the present invention.

A method of producing the dielectric resonator of the present invention will be now described with reference to FIG. 3.

Figure 4:
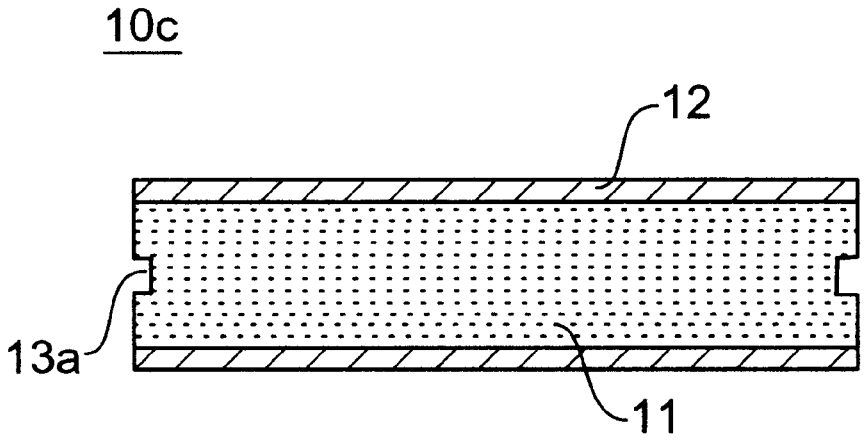
FIG. 4 is a cross sectional view of a dielectric resonator according to another embodiment of the present invention.

First, the dielectric resonator 10, obtained by forming the thin film multi-layer electrodes 12 on the two faces opposite to each other of the columnar dielectric 11, is mounted on a rotation apparatus 14. The rotation apparatus 14 is equipped with a suction means for sucking the dielectric resonator 10 from below. The dielectric resonator 10 is fixed by means of the sucking means. After the dielectric resonator 10 is fixed, the rotation apparatus 14 is rotated in the horizontal direction, and thereby, the dielectric resonator 10 is also rotated in the horizontal direction. To cut the side face of the dielectric resonator 10, a diamond bar 15 having a disk shape under rotation is pressed to the side-face of the dielectric resonator 10 which is also under rotation. By such a method as above described, the dielectric resonator 10 having a concave portion 13 substantially evenly formed on the peripheral side-face thereof excluding the thin film multi-layer electrodes 12, as shown in FIGS. 1 and 2, can be easily formed. If the diamond bar 15 having a spherical shape is used as the cutting means, the dielectric resonator 10*c* with the concave portion 13a having a concave shape as shown in the cross sectional view of FIG. 4.

If the dielectric resonator 10 is produced by the above-described method, the resonant frequency of the dielectric resonator 10 can be adjusted without the thin film multi-layer electrodes 12 short-circuited, and thereby, it is unnecessary to carry out the etching of the thin film multi-layer electrodes 12 after the peripheral side-face is cut. In addition, since the concave portion 13 on the peripheral side-face of the dielectric resonator 10 is formed substantially evenly there, the symmetric structure of the dielectric resonator 10 is not unbalanced, and the current distribution is prevented from being disturbed. Accordingly, the reduction of the nonloaded Q of the dielectric resonator 10 is prevented.

Figure 5:
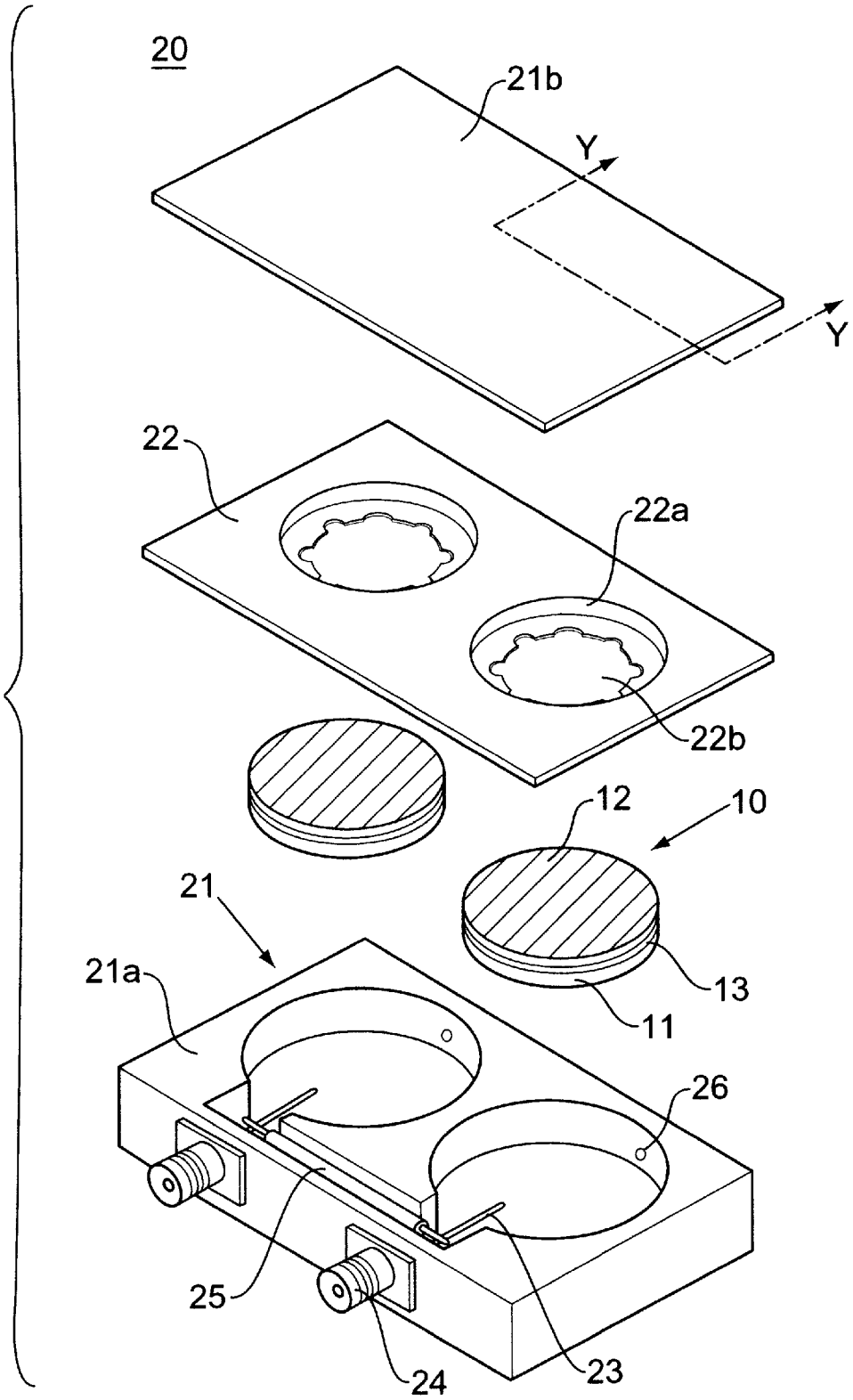
FIG. 5 is an exploded perspective view of a dielectric filter of the present invention.
Figure 6:
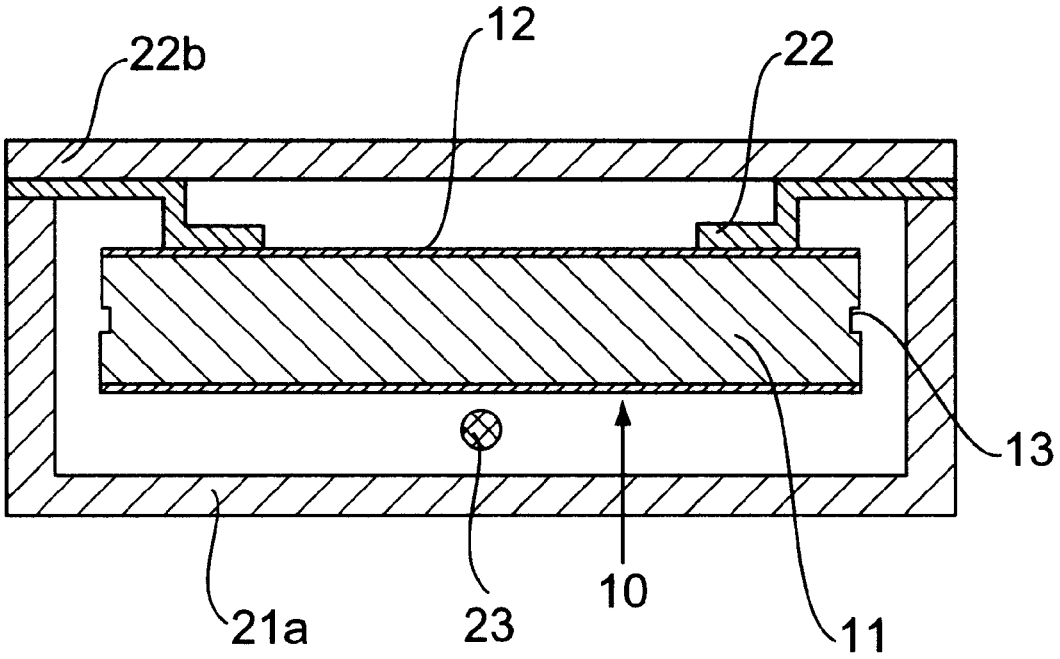
FIG. 6 is a cross sectional view taken on line Y—Y of FIG. 5.

Further, the dielectric filter according to an embodiment of the present invention will be now described with reference to FIGS. 5 and 6. FIG. 5 is an exploded perspective view of the dielectric filter of the instant embodiment. FIG. 6 is a cross sectional view taken on line Y—Y of FIG. 5. In this case, a two-stage band-elimination filter in which two dielectrics arranged laterally are connected through a quarter-wave line.

A dielectric filter 20 of the instant embodiment, as shown in FIGS. 5 and 6, is made up of a shield cavity 21 made of iron plated with silver, two dielectric resonators 10 having a columnar shape arranged in the shield cavities 21, an ground plate 22, electrical probes 23 as external coupling means,- and external connectors 24 attached to the shield cavities 21, respectively.

The thin film multi-layer electrodes 12 are formed on two faces opposite to each other of the dielectric resonator 10. The ground plate 22 made of a copper sheet plated with silver, having steps 22*a* and holes 22*b* for soldering plated with silver is soldered to one of the two faces. The ground plate 22 is sandwiched between the body 21*a* of the shield cavity 21 and the lid 21*b* in such a manner that the ground plate 22 is in conduction with the shield cavity 21. Thus, the dielectric resonators 10 are arranged in the shield cavities 21. Electrical probes 23 made of metallic wires are arranged, elongating in the spaces between the electric resonators 10 and the shield cavity 21, respectively. One end of the electrical probe 23 is attached to an external connector 24 fixed to the shield cavity 21. Moreover, the center conductors of the two external connectors 24 are connected through the quarter-wave line 25.

In the dielectric filter 20 of the instant embodiment, as shown in the cross sections of FIGS. 5 and 6, the concave portions 13 are substantially evenly formed on the peripheral side-faces of the dielectric resonators 10 arranged in the shield cavities 21, other than the thin film multi-layer electrodes 12. By use of such a dielectric resonators 10, the resonant frequency of the dielectric resonators 10 can be adjusted while the symmetric structure of the dielectric resonators 10 is kept, namely, the current distribution of the dielectric resonators 10 is not prevented -from being disturbed. Thus, the reduction of the nonloaded Q is prevented.

In the dielectric filter 20 having the above-described structure, an input signal when it is input through the external connector 24 is fed to the electrical probe 23, so that the electrical probe 23 and the dielectric resonator 10 are capacitive-coupled. Thus, at a resonant frequency determined by the shape and size of the dielectric resonators 10, the dielectric resonators 10 become resonat. Thus, the dielectric filter 20 in which the dielectric resonators are connected through the quarter-wave line 25 functions as a two stage band-elimination filter for eliminating desired frequency waves.

To carry out the fine adjustment of the dielectric resonators 10 to such a degree that the symmetric structure of the dielectric resonator 10 is not unbalanced, after the dielectric resonators 10 are arranged in the shield cavity 21, a fine amount of the dielectric may be cut from holes 26 provided in the shield cavity 21 by means of a fluter or the like.

Figure 7:
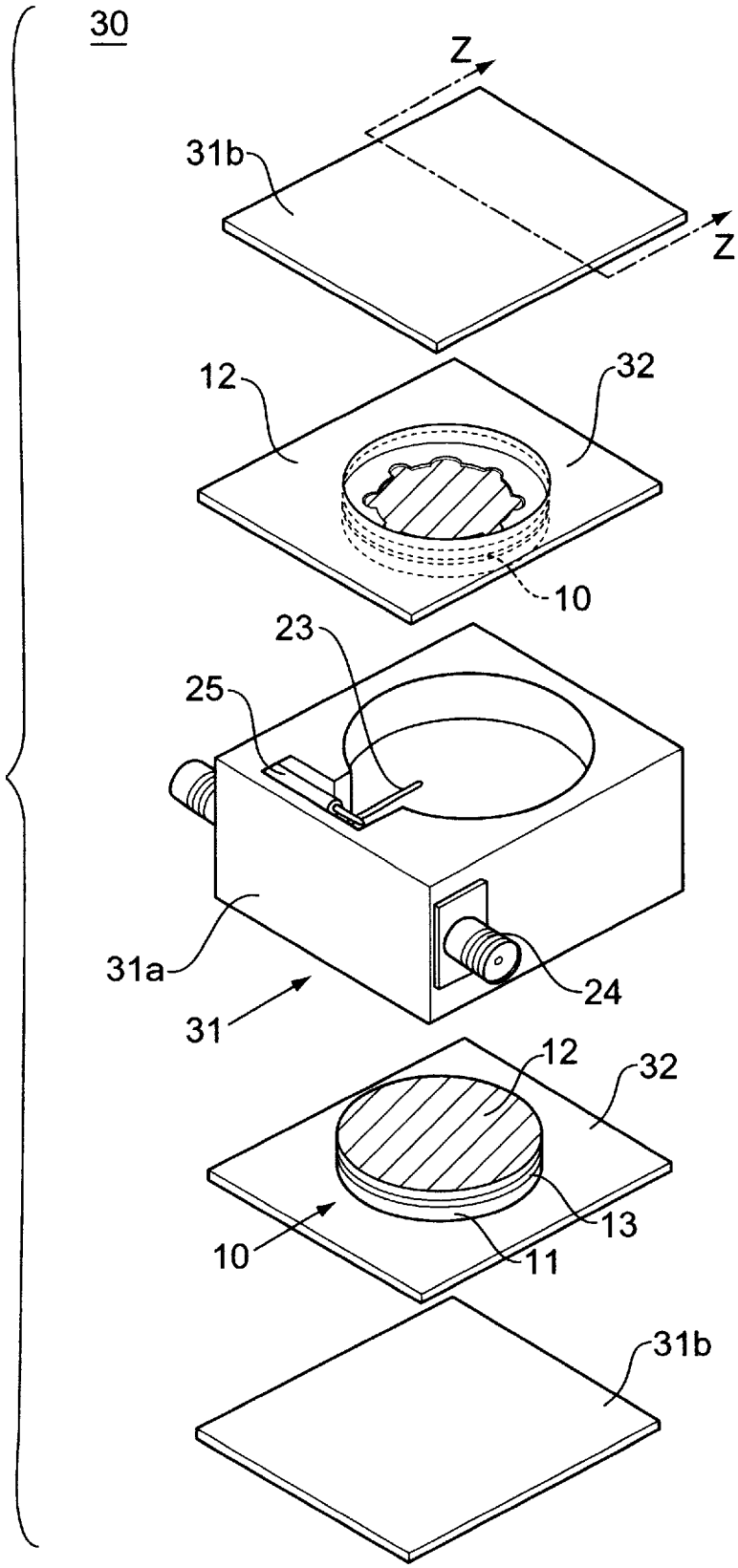
FIG. 7 is an exploded perspective view of a dielectric filter according to a still further embodiment of the present invention.
Figure 8:
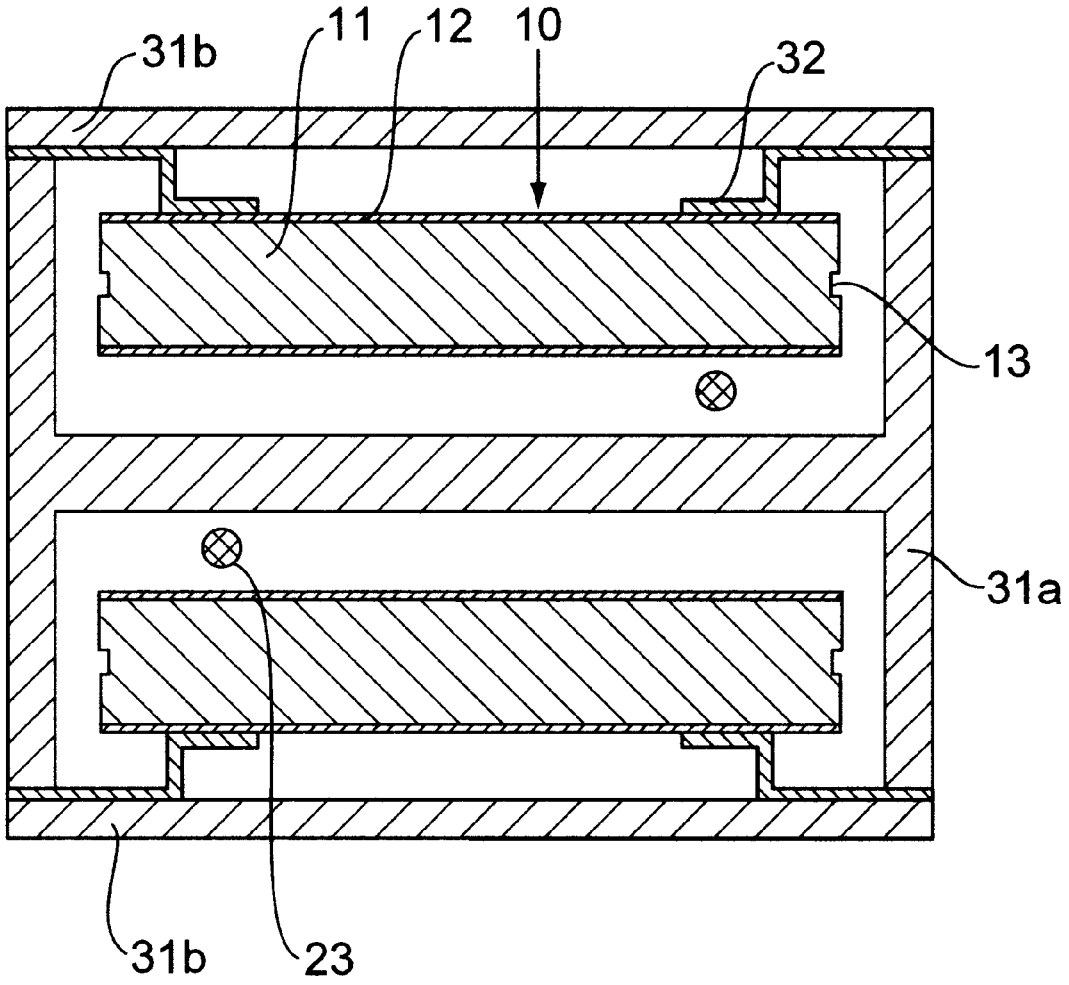
FIG. 8 is a cross sectional view taken on line Z—Z of FIG. 7.

Further, another embodiment of the dielectric filter of the present invention will be now described with reference to FIGS. 7 and 8. FIG. 7 is an exploded perspective view of the dielectric filter of the instant embodiment. FIG. 8 is a cross sectional view taken on line Z—Z of FIG. 7. Like numerals refer to like parts in the instant and above-described embodiments, and detailed description of the like parts will be omitted below.

In the instant embodiment, as shown in FIGS. 7 and 8, the dielectric filter 30 is made up of a shield cavity 31 made of iron plated with silver, two columnar dielectric resonators 10 arranged in the shield cavity 31, a ground plate 32, an electrical probe 23 as an external coupling means, and an external connector 24 attached to the shield cavity 31.

The difference between the instant and above-described embodiments lies in that the two electric resonators 10 are laterally arranged in the above-described embodiment, while in the instant embodiment, the dielectric resonators 31 are arranged on the front and back sides of the shield cavity 31. In addition, in the above-described embodiment, the height of the dielectric filter is reduced, while in the instant embodiment, the area of the dielectric filter 30 can be reduced. These arrangements can be selected and applied, depending on the circumstances.

As shown in FIGS. 7 and 8, in the dielectric filter 30 of the instant embodiment, the concave portion 13 is formed substantially evenly on the peripheral side-face of the dielectric resonator 10 excluding the thin film multi-layer electrodes 12. By use of the dielectric resonator 10, the resonant frequency of the dielectric resonator 10 can be adjusted while the symmetrical structure of the dielectric resonator 10 is kept, that is, the current distribution of the dielectric resonator 10 is prevented from being disturbed. Thus, the reduction of the nonloaded Q is prevented.

In the dielectric filter 30 having the above configuration, an input signal when it is input through the external connector 24 is fed to the electrical probe 23, so that the electrical probe 23 and the dielectric resonator 10 are capacitive-coupled. Then, at the resonant frequency determined by the shape and size of the dielectric resonator 10, the arrangement of the dielectric resonator 10, and the like, the dielectric resonator 10 becomes resonat. Thus, the dielectric filter 30 in which the dielectric resonators are connected to each other through the quarter-wave line 25 functions as a two-stage band-elimination dielectric filter for eliminating desired frequency waves.

Figure 9:
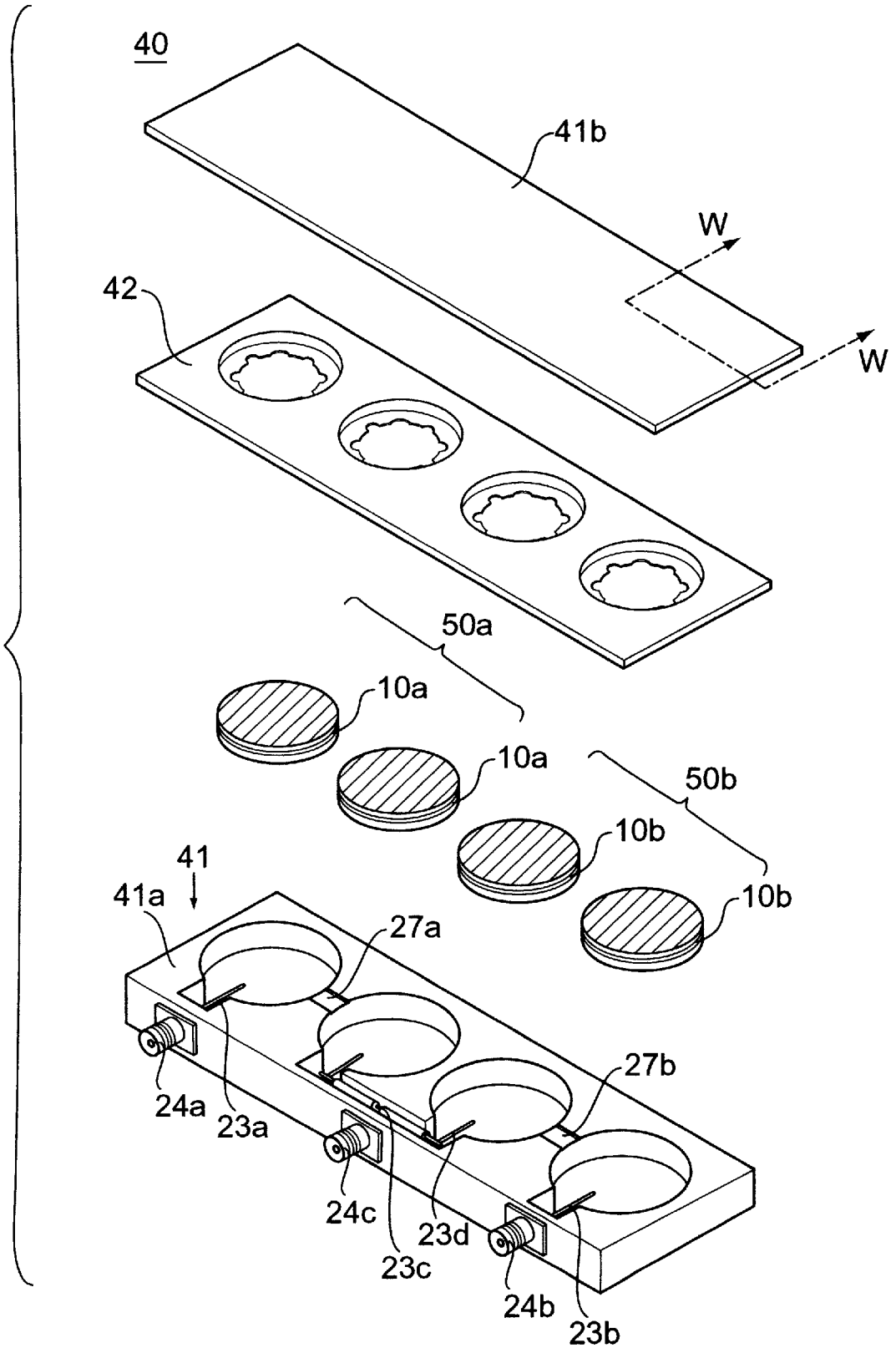
FIG. 9 is an exploded perspective view of a dielectric duplexer of the present invention.
Figure 10:
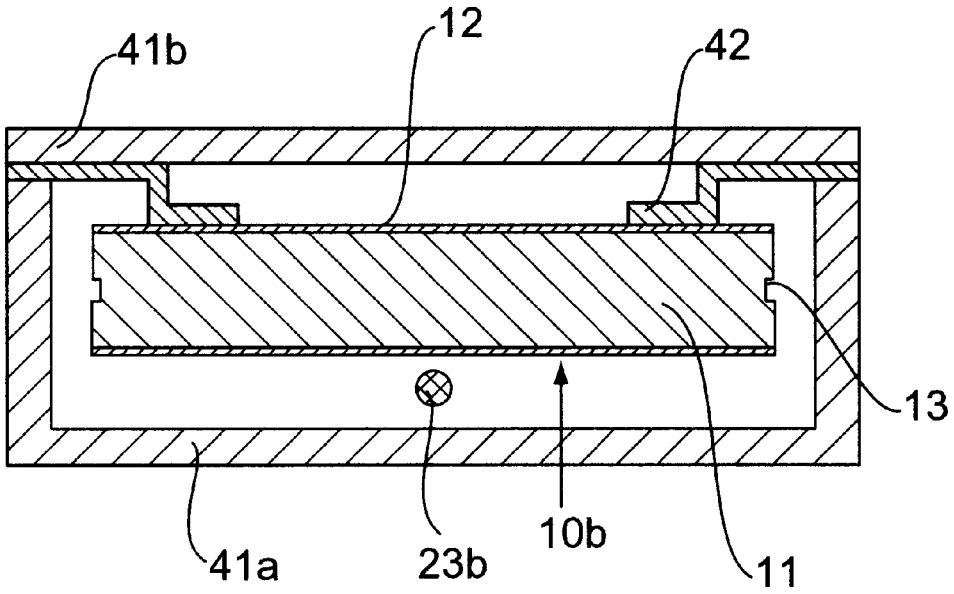
FIG. 10 is a cross sectional view taken on line W—W of FIG. 9.

Further, the dielectric duplexer according to an embodiment of the present invention will be now described with reference to FIGS. 9 and 10. FIG. 9 is an exploded perspective view of the dielectric duplexer of the instant embodiment. FIG. 10 is a cross sectional view taken on line W—W of FIG. 9. Like numerals refer to like parts in the instant and above-described embodiments. Detailed description of the like parts will be omitted below.

As shown in FIGS. 9 and 10, the dielectric duplexer 40 of the instant embodiment includes a first dielectric filter 50*a* made up of two columnar dielectric resonators parts 10*a* arranged in the shield cavity 41, and a second dielectric filter 50*b* made up of another two columnar dielectric resonator parts 10*b*. The two dielectric resonators 10*a* making up the first dielectric filter part 50*a* are capacitive-coupled through a coupling member 27*a* whereby a transmission band pass filter is produced. The two dielectric resonators 10*b* making up the second dielectric filter part 50*b* has a resonant frequency different from the dielectric resonator 10*a* of the first dielectric filter part 50*a*, and capacitive-coupled through a coupling member 27*b*, whereby a receiving band-pass filter is produced. An electrical probe 23*a* as an external coupling means to be coupled to the dielectric resonator 10*a* is connected to an external connector 24*a* and further connected to an external transmission circuit. In addition, the electrical probe 23*b* to be coupled to the dielectric resonator 10*b* of the second dielectric filter part 50*b* is connected to an external connector 24*b*, and further connected to an external receiving circuit. Further, the electrical probes 23*c* to be coupled to the dielectric resonator 10*a* of the first dielectric filter part 50*a*, and an electrical probe 23*d* to be coupled with the dielectric resonator 10*b* of the second dielectric filter part 50*b* is connected to an external connector 24*c* and further connected to an external antenna.

In the dielectric duplexer 40 having the above configuration, a predetermined frequency wave is made to pass through the first dielectric filter part 50*a*, and moreover, a frequency wave different from the above frequency wave is caused to pass through the second dielectric filter 50*b*. Thus, the dielectric duplexer 40 functions as a band-pass dielectric duplexer.

As shown in FIGS. 9 and 10, also in the dielectric duplexer 40 of the present invention, the substantially even concave portion 13 is formed on the peripheral side-faces of the dielectric resonators 10*b* arranged in the shield cavity 41, excluding the thin film multi-layer electrodes 12. By use of the above-described dielectric resonators 10*b*, the resonant frequency of the dielectric resonators 10*b* can be adjusted while the symmetrical structure of the dielectric resonator 10*b* is kept, that is, without disturbances in the current distribution of the dielectric resonators 10*b*. That is, the nonloaded Q is not reduced. This is true of the dielectric resonators 10*a*.

Figure 11:
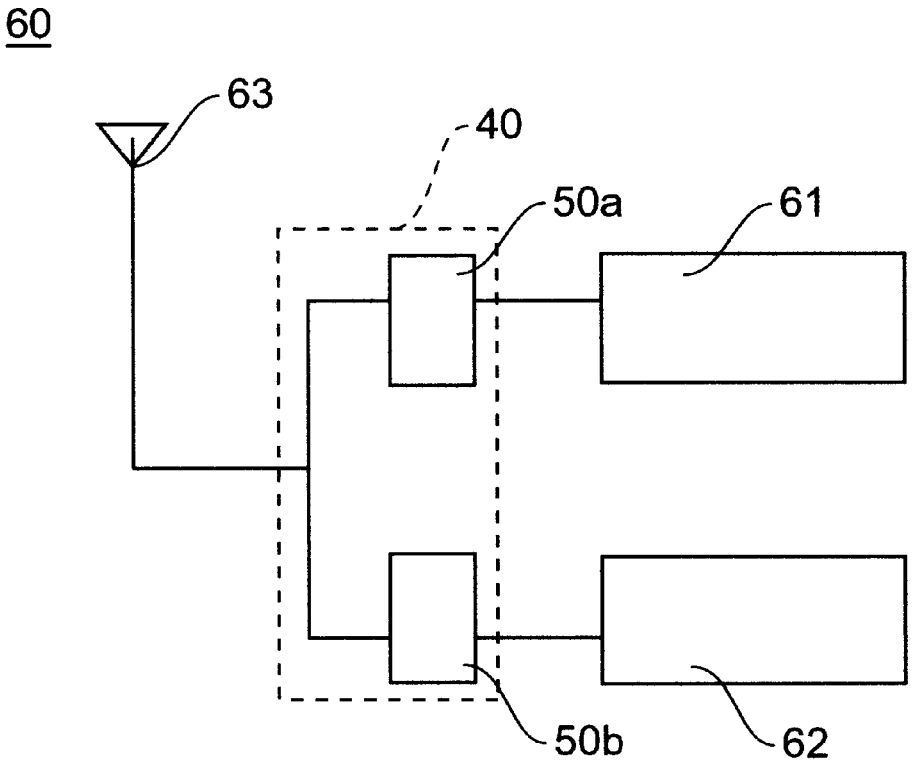
FIG. 11 is a schematic view of a communication device of the present invention.
Figure 12:
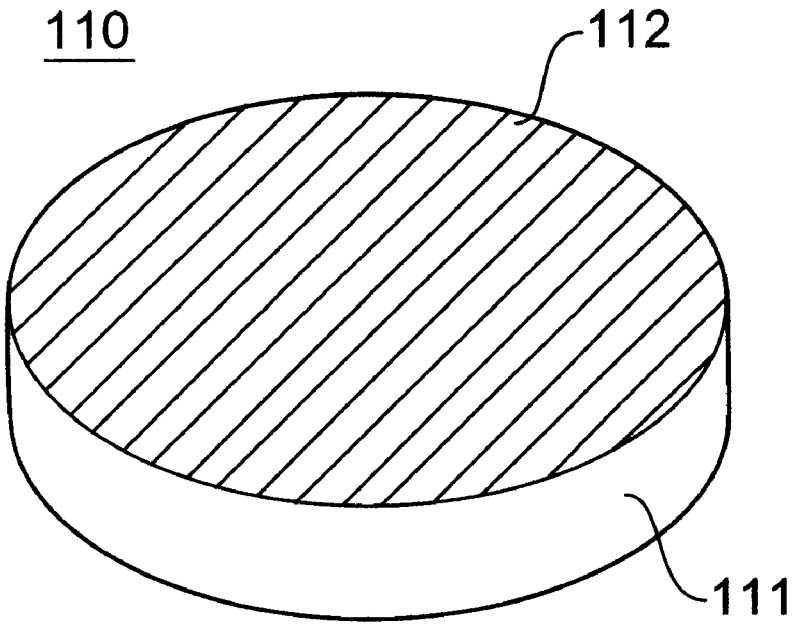
FIG. 12 is a perspective view of a conventional dielectric resonator.
Figure 13:
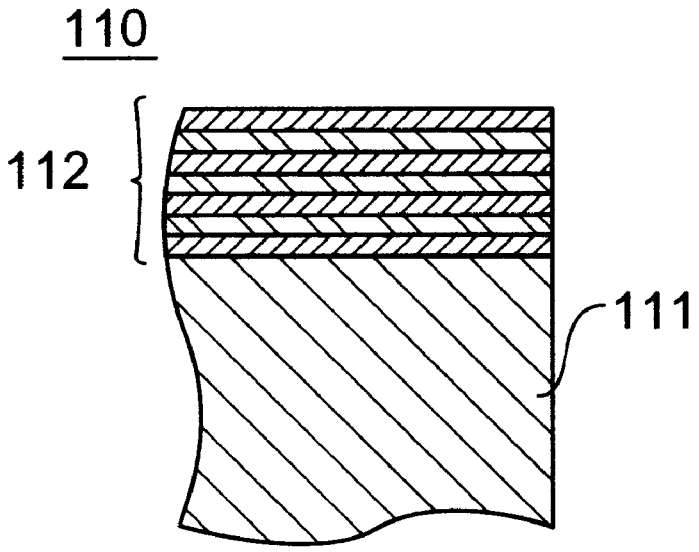
FIG. 13 is a partially cross sectional view of one end of the conventional dielectric resonator.
Figure 14:
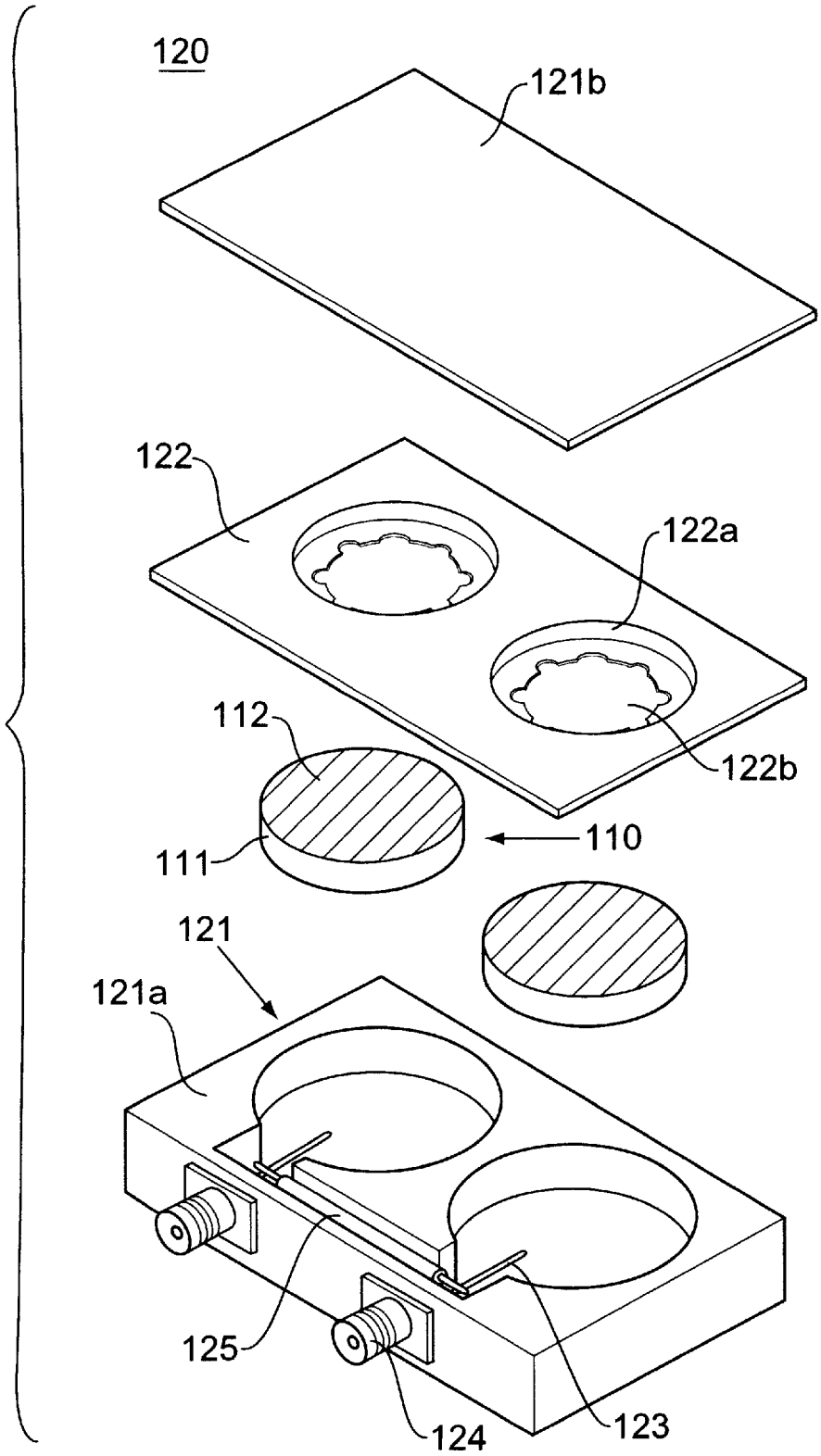
FIG. 14 is an exploded perspective view of a conventional dielectric filter.
Figure 15:
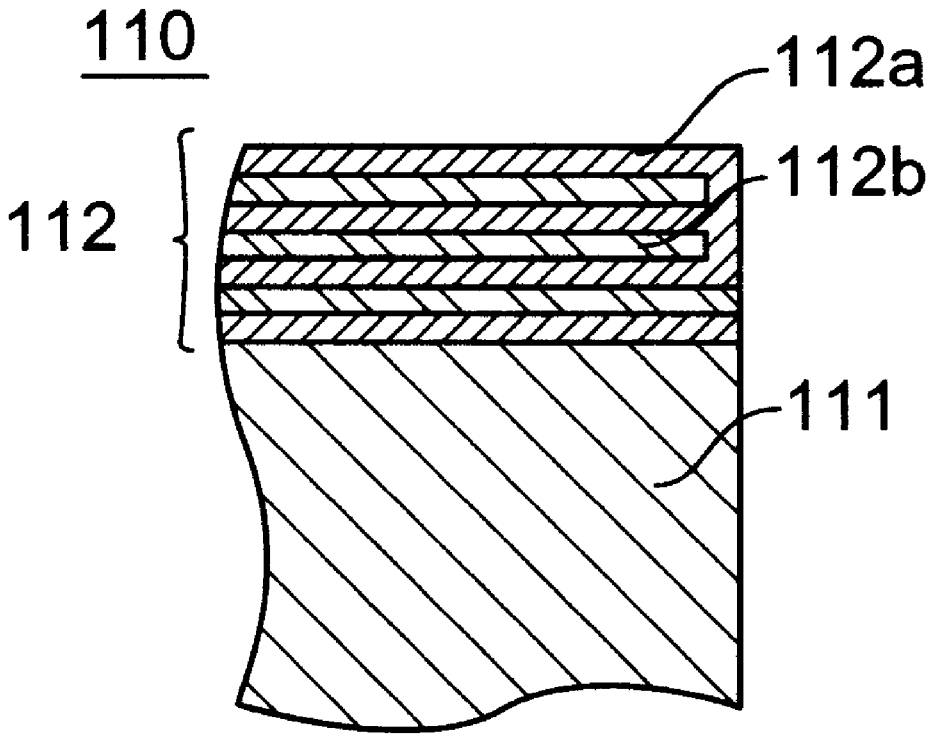
FIG. 15 is a partially cross sectional view of one end of a dielectric resonator in which the metallic layers of the thin film multi-layer electrode are short-circuited.

Furthermore, a communication device 60 according to an embodiment of the present invention will be now described with reference to FIG. 11. FIG. 11 is a schematic view of the communication device of the instant embodiment.

As shown in FIG. 11, a communication device 60 of the instant embodiment is made up of a dielectric duplexer 40, a transmitting circuit 61, a receiving circuit 62, and an antenna 63. The dielectric duplexer 40 is the same that is described in the above embodiment. The external connector 24*a* connected to the first dielectric filter part 50*a* in FIG. 9 is connected to a transmitting circuit 61. The external connector 24*b* connected to the second dielectric filter part 50*b* is connected to a receiving circuit 62. Further, the external connector 24*c* is connected to an antenna 63.

Also in the communication device 60 of the instant embodiment, a substantially even concave portion is formed on the peripheral side-face of each dielectric resonator arranged in the shield cavity, excluding the thin film multi-layer electrode. By use of the above-described dielectric resonator, the resonant frequency of the dielectric resonator can be adjusted while the symmetrical structure of the dielectric resonator is kept, that is, without the current distribution of the dielectric resonator disturbed. Thus, the nonloaded Q is not reduced.

As seen in the above description, the substantially even concave portion is formed on the peripheral side face of each dielectric resonator containing the columnar dielectric having the thin film multi-layer electrodes formed on the opposite sides of the dielectric, the peripheral side faces not containing the thin film multi-layer electrodes. Thus, the resonant frequency can be adjusted with the depth and width of the concave portion without the thin film multi-layer electrodes short-circuited. In addition, since the symmetrical structure of the dielectric resonators is kept, the disturbance of the current distribution is prevented. Accordingly, the dielectric resonator with a high non-loading Q factor can be provided. In addition, by use of the above-described dielectric resonator, the dielectric filter, the dielectric duplexer, and the communication device each having high characteristics can be provided.

Further, the method of producing the dielectric resonator comprises securing the dielectric resonator to the rotation apparatus, and substantially evenly cutting the peripheral side-face of the dielectric resonator with a cutting means. Thus, the resonant frequency can be easily adjusted without the thin film multi-layer electrodes formed on the two side opposite to each other of the dielectric resonator short-circuited. Thus, processes such as etching or the like are unnecessary.

What is claimed is:

1. A dielectric resonator comprising a substantially columnar dielectric having a resonant region adapted for resonance at a frequency, a thin film multi-layer electrode formed on at least one of two faces opposite to each other of the dielectric, and a concave portion formed substantially evenly around the peripheral side face of the resonant region of the dielectric.

2. A dielectric filter comprising a shield cavity with conductive properties, a dielectric resonator, and an external coupling which electromagnetically couples to the dielectric resonator, said dielectric resonator including a substantially columnar dielectric having a resonant region adapted for resonance at a frequency arranged in the shield cavity, a thin film multi-layer electrode formed on at least one of two faces opposite to each other of the dielectric, and a concave portion formed substantially evenly around the peripheral side face of the resonant region of the dielectric.

3. A dielectric duplexer comprising:

a shield cavity with electroconductive properties, a dielectric resonator, an external coupling which electromagnetically coupled to the dielectric resonator, and an input-output connection which is connected to the external coupling and to an antenna connection, said dielectric resonator including a substantially columnar dielectric having a resonant region adapted for resonance at a frequency arranged in the shield cavity, a thin film multi-layer electrode formed on at least one of two faces opposite to each other of the dielectric, and a concave portion formed substantially evenly around the peripheral side face of the resonant region of the dielectric.

4. A communication device comprising a dielectric duplexer, one of a transmission circuit and a receiving circuit connected to the dielectric duplexer, said dielectric duplexer including a shield cavity with conductive properties, a dielectric resonator, an external coupling which electromagnetically couples to the dielectric resonator, an input-output connection connected to the external coupling and to an antenna connection, said dielectric resonator including a substantially columnar dielectric having a resonant region adapted for resonance at a frequency arranged in the shield cavity, a thin film multi-layer electrode formed on at least one of two faces opposite to each other of the dielectric, and a concave portion formed substantially evenly around the peripheral side-face of the resonant region of the resonator.

5. A method of producing a dielectric resonator which comprises the steps of:

forming a thin film multi-layer electrode on at least one of two faces opposite to each other of a substantially columnar dielectric and an electrode on the other face to define a resonant region between said electrodes, fixing said dielectric to a rotation apparatus, and rotating said dielectric to cut substantially evenly the dielectric around the peripheral side-face of the resonant region thereof with a cutter.

6. The dielectric resonator of claim 1, wherein said resonant region is defined between said multi-layer electrode and a second electrode on the other of said two faces of the dielectric.

7. The dielectric resonator of claim 6, wherein said dielectric has substantially the same dimensions on opposite sides of said concave portion.

8. The dielectric resonator of claim 1, wherein said dielectric has substantially the same dimensions on opposite sides of said concave portion.

9. The dielectric filter of claim 2, wherein said resonant region is defined between said multi-layer electrode and a second electrode on the other of said two faces of the dielectric.

10. The dielectric filter of claim 9, wherein said dielectric has substantially the same dimensions on opposite sides of said concave portion.

11. The dielectric filter of claim 2, wherein said dielectric has substantially the same dimensions on opposite sides of said concave portion.

12. The dielectric duplexer of claim 3, wherein said resonant region is defined between said multi-layer electrode and a second electrode on the other of said two faces of the dielectric.

13. The dielectric duplexer of claim 12, wherein said dielectric has substantially the same dimensions on opposite sides of said concave portion.

14. The dielectric duplexer of claim 3, wherein said dielectric has substantially the same dimensions on opposite sides of said concave portion.

15. The communication device of claim 4, further comprising an antenna connected to said dielectric duplexer.

16. The communication device of claim 4, wherein said resonant region is defined between said multi-layer electrode and a second electrode on the other of said two faces of the dielectric.

17. The communication device of claim 16, wherein said dielectric has substantially the same dimensions on opposite sides of said concave portion.

18. The communication device of claim 4, wherein said dielectric has substantially the same dimensions on opposite sides of said concave portion.

19. The method according to claim 5, wherein said resonant region is initially adapted for resonance at a first frequency, and said cutting step adjusts said resonant region for resonance at a second frequency which is different from said first frequency.

* * * * *